US006202001B1

(12) United States Patent
Muto

(10) Patent No.: US 6,202,001 B1
(45) Date of Patent: Mar. 13, 2001

(54) EMBROIDERY DATA CREATING DEVICE

(75) Inventor: Yukiyoshi Muto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/042,669

(22) Filed: Mar. 17, 1998

(30) Foreign Application Priority Data

Mar. 21, 1997 (JP) ..... 9-067692

(51) Int. Cl.[7] ..... D05C 5/02

(52) U.S. Cl. ..... 700/138; 700/138; 700/136; 700/137; 112/102.5; 112/155; 364/470

(58) Field of Search ..... 700/138, 137, 700/136; 112/102.5, 155, 273, 300, 470; 364/470, 471

(56) References Cited

U.S. PATENT DOCUMENTS 5,558,031 * 9/1996 Muto et al. ..... 112/102.5
5,791,271 * 8/1998 Futamura ..... 112/102.5
5,875,725 * 3/1999 Mizuno ..... 112/102.5
5,880,963 * 3/1999 Futamura ..... 364/470.09
5,896,822 * 4/1999 Futamura ..... 112/102.5
5,911,181 * 6/1999 Muto ..... 112/102.5
5,934,209 * 8/1999 Pearson et al. ..... 396/6
5,957,068 * 9/1999 Mizuno ..... 112/102.5
5,972,220 * 10/1999 Bailey ..... 210/605

* cited by examiner

*Primary Examiner*—Ayaz R. Sheikh
*Assistant Examiner*—Firmin Backer
(74) *Attorney, Agent, or Firm*—Oliff & Berridge, PLC

(57) ABSTRACT

Disclosed is an embroidery data creating device for creating embroidery stitch data representative of cyclically repeated embroidery patterns to be formed on an embroidery area. The embroidery data creating device includes a first memory in which data related to the embroidery area is stored. The embroidery area has at least one embroidery block. Further, the embroidery data creating device is provided with a second memory in which reference pattern data indicative of a unit pattern of the cyclically repeated embroidery patterns is stored. A data generating device which is also included in the embroidery data creating device, creates the embroidery stitch data for the embroidery area stored in the first memory in accordance with the reference pattern stored in the second memory. In particular, the data generating device generates the embroidery stitch data by arranging the reference pattern data repeatedly within the embroidery area.

20 Claims, 12 Drawing Sheets

EMBROIDERY DATA CREATING DEVICE

BACKGROUND OF THE INVENTION

The present invention relates to an embroidery data creating device for creating embroidery data to be used in embroidery sewing machines.

Conventionally, embroidery sewing machines are desired to embroider various stitch patterns, and various embroidery data creating devices therefor have been developed. Such embroidery data creating devices may create data representative of an embroidery whose stitching pattern changes in a direction where an embroidering operation proceeds.

When the embroidery data creating devices as described above create the embroidery data, for example, an area to be embroidered is divided into a plurality of embroidery blocks. The embroidery block is, for example, defined by two borders (main borders) extending in a direction in which embroidering operation proceeds and two borders (auxiliary borders) perpendicular to the main borders.

In order to assign stitches to the embroidery blocks, each of the main borders of the embroidery block is divided evenly, and by connecting divided points of both the main borders alternately.

In such an embroidery data creating device, for example, if a satin stitch and a Tatami stitch are assigned alternately, the stitch pattern changes along a direction where the embroidering operation proceeds as shown in FIG. 1. If the main borders are divided not evenly but a density of divided points are varied, the stitch pattern changes, in the direction where the embroidering operation proceeds, as shown in FIG. 2.

In the conventional embroidery data creating devices, when the embroidery data representing the stitch patterns as shown in FIGS. 1 and 2 are to be created, an operator must divide the area into blocks, and further assign the stitch patterns (e.g., the satin stitch, Tatami stitch, and the like) to every block. Thus, in the conventional embroidery data creating device, it is troublesome to create the embroidery data if the embroidery consists of a repetitive patterns in the direction where the embroidering operation proceeds.

SUMMARY OF THE INVENTION

It is therefore an object of the invention to provide an improved embroidery date creating device with which the embroidery data representing repetitive patterns can be created easily.

For the object, according to the invention, there is provided an embroidery data creating device for creating embroidery stitch data representative of cyclically repeated embroidery patterns to be formed on an embroidery area, which comprises a first memory, which stores data related to the embroidery area, the embroidery area including at least one embroidery block; a second memory, which stores reference pattern data indicative of a unit pattern of the cyclically repeated embroidery patterns; and a data generating device, which creates the embroidery stitch data for the embroidery area stored in the first memory in accordance with the reference pattern stored in the second memory.

In particular, the data generating device generates the embroidery stitch data by arranging the reference pattern data repeatedly within the embroidery area.

With this constitution, the embroidery stitch data representing the cyclically repeated patterns can be created by repeatedly arranging the reference pattern. Accordingly, data creating operation can be made easier, and less troublesome.

Optionally, the at least one embroidery block comprises a block defined by a pair of line segments extending in a direction where an embroidery operation is to proceed, and another pair of line segments connecting the ends of the pair of line segments extending in a direction where an embroidery operation is to proceed, and wherein the pair of line segments extending in a direction where an embroidery operation is to proceed are straight line segments.

Optionally or alternatively, the pair of line segments may have curved portions.

Further optionally or alternatively, the embroidery area is an annular shaped area.

It is preferable that the reference pattern data may represent a pattern including a plurality of different stitching methods.

In this case, the plurality of different stitching methods may include a Tatami stitch and/or a satin stitch.

Further optionally, the reference pattern data may represent a pattern within which a density of thread segments is varied and/or a pattern including a plurality of kinds of Tatami stitches.

In particular, the plurality of kinds of Tatami stitches may include Tatami stitches having different stitching pitches.

Alternatively, the plurality of kinds of Tatami stitches may include Tatami stitches having different stitch point shifting ratios.

Optionally or alternatively, the at least one embroidery block may comprise a first embroidery block and a second embroidery block, and the data generating device may arrange a plurality of the reference patterns one by one in the first and second embroidery blocks. In this case, if only a portion of the reference pattern is used as a lastly arranged reference pattern in the first embroidery block, the remainder of the reference pattern is used as a firstly arranged reference pattern in the second embroidery block.

Still optionally, the embroidery data creating device may be provided with a removable memory device for storing the embroidery stitch data generated by the data generating device.

Further optionally, the removable memory device can be coupled to an embroidery sewing machine, and the embroidery stitch data stored in the removable memory device can be supplied to the embroidery sewing machine when it is coupled thereto. In this case, the embroidery sewing machine may embroider in accordance with the embroidery stitch data stored in the removable memory device.

According to another aspect of the invention, there is provided an embroidery data creating device for creating embroidery stitch data for an embroidery area consisting of at least one embroidery block, which may include means for dividing each of the at least one embroidery block into at least one sub-block having a predetermined width in a direction where the at least one embroidery block is divided; and means for developing each of the at least one sub-block into embroidery stitch data with reference to reference pattern data indicative of an embroidery pattern including a plurality of portions having different characteristics.

According to further aspect of the invention, there is provided a computer accessible memory medium for an embroidery data creating device for creating embroidery stitch data representative of cyclically repeated embroidery patterns to be formed on an embroidery area, the memory medium containing a program to be executed by the embroidery data creating device. The program includes steps of storing data related to the embroidery area, the embroidery area including at least one embroidery block; storing reference pattern data indicative of a unit pattern of the cyclically repeated embroidery patterns; and generating the embroidery stitch data for the embroidery area in accordance with the reference pattern data.

Optionally, the embroidery stitch data may be generated by arranging the reference pattern data repeatedly within the embroidery area.

Further optionally, the at least one embroidery block may include a block defined by a first pair of line segments extending in a direction where an embroidery operation is to proceed, and a second pair of line segments connecting the ends of the first pair of line segments. In this case, the first pair of line segments may be straight line segments. Alternatively or optionally, the first pair of line segments may have curved portions.

DESCRIPTION OF THE ACCOMPANYING DRAWINGS

DESCRIPTION OF THE EMBODIMENT

The present invention will be described with reference to the accompanying drawings.

In an embroidery data creating system according to the present invention, in order to create embroidery data representing repetitive patterns in a direction where an embroidering operation proceeds, a cycle M and reference stitch pattern data representing one embroidery cycle is defined. Then, each embroidery block included in an embroidery area is divided into sub-blocks, and the sub-blocks are developed into the stitch pattern data in accordance with the reference stitch pattern data. The stitch pattern data thus created is stored in a recording medium such as a flash memory card or the like which can be used for personal sewing machines.

Figure 3:
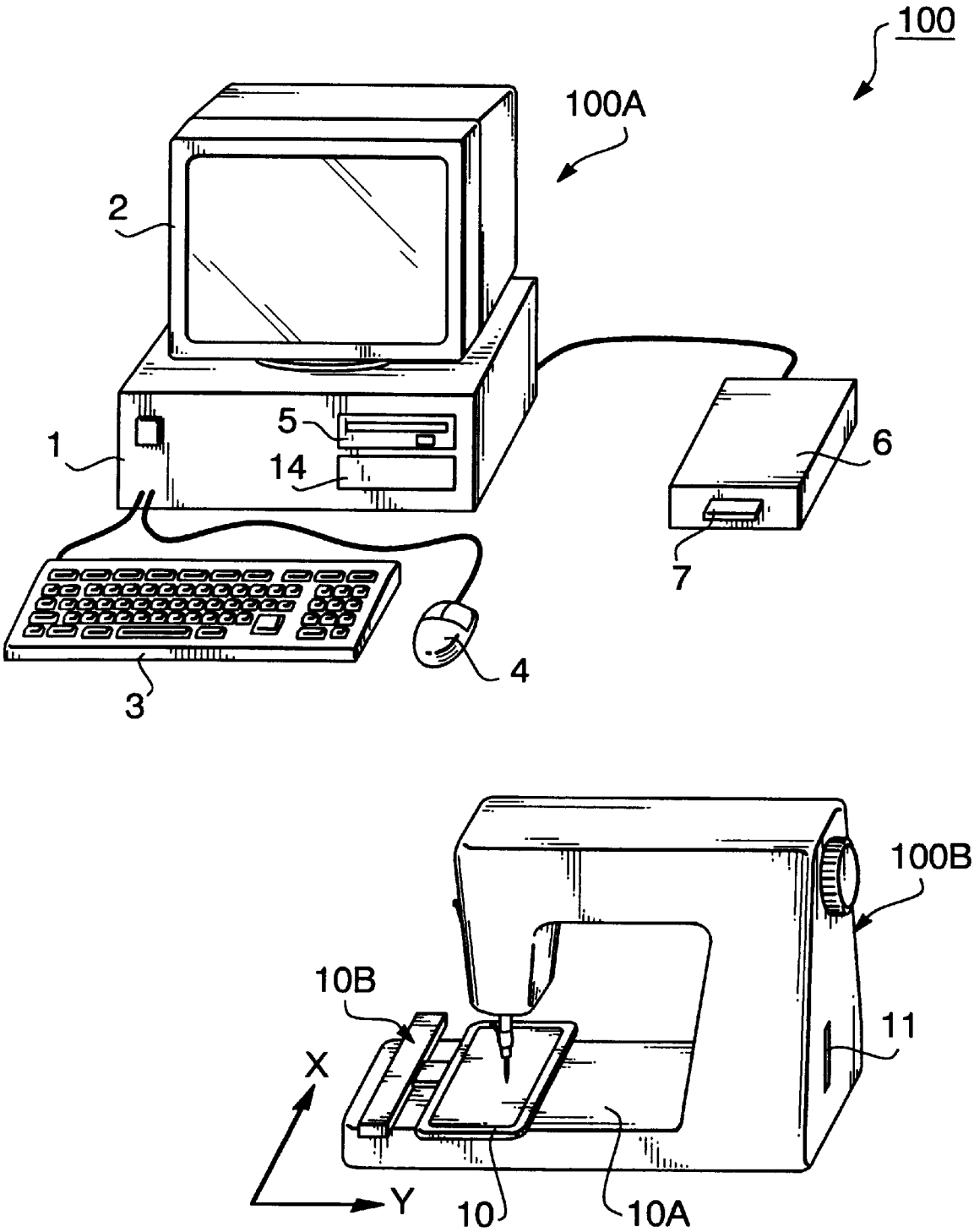
FIG. 3 shows an embroidery data creating device and an embroidery sewing machine utilizing the embroidery data created by the embroidery data creating device.
Figure 4:
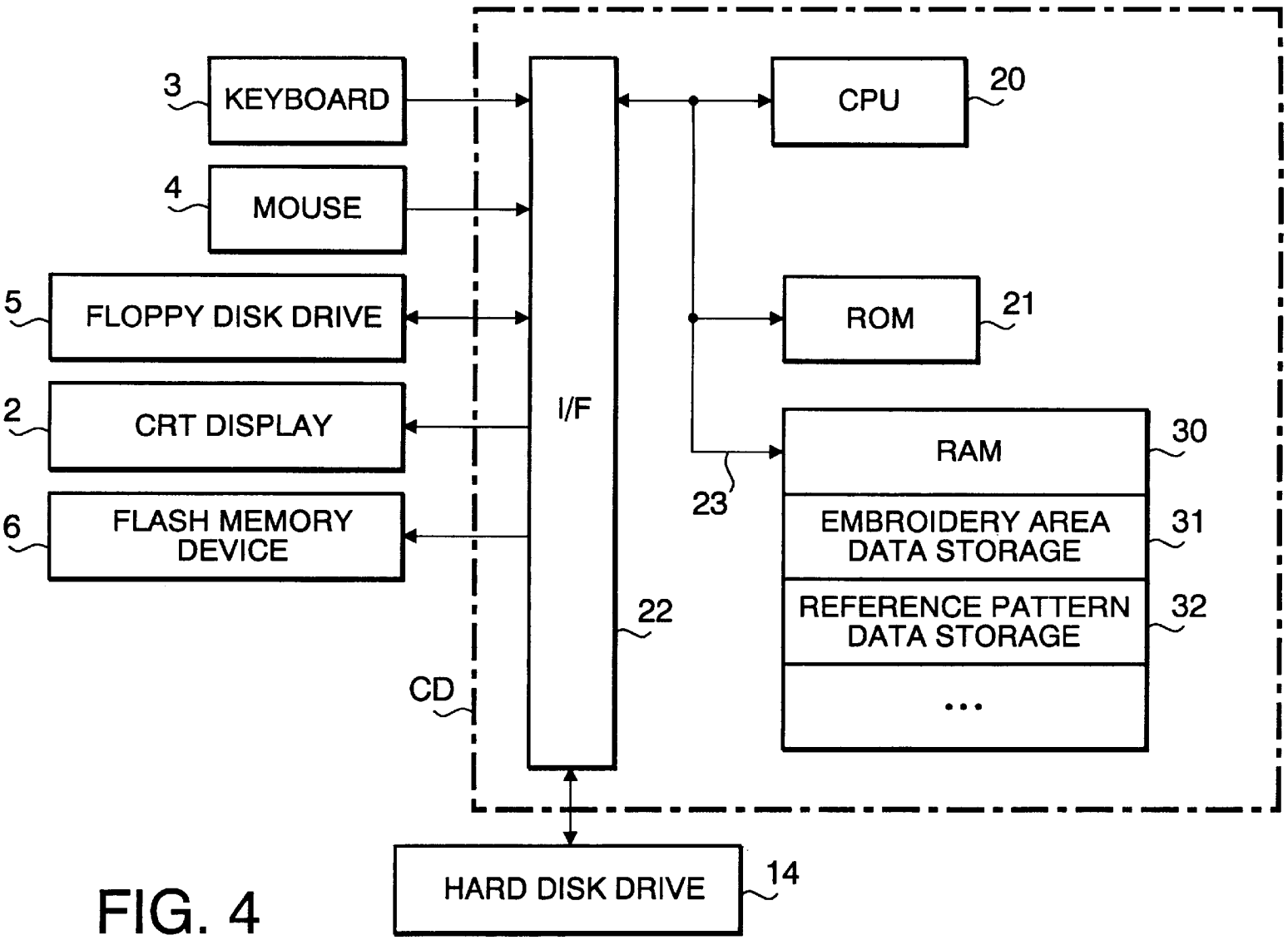
FIG. 4 is a block diagram of a control system of the embroidery data creating device.

FIG. 3 shows the embroidery data processing system 100 including an embroidery data creating device 100A and an embroidery sewing machine 100B which uses the embroidery data created by the embroidery data creating device 100A.

The embroidery data creating device 100A includes:

- a CRT (Cathode Ray Tube) display 2 for displaying embroidery block data, embroidery stitch data, and the like;
- a keyboard 3 and a mouse 4 for inputting and/or selecting stitch pattern data;
- a floppy disk drive 5 and a hard disk drive 14 used for reading/writing embroidery block data, embroidery stitch data and the like;
- a flash memory device 6 for storing the embroidery stitch data in a removable memory card 7 including a non-volatile flash memory.

The personal sewing machine 100B has a work frame 10 for holding work cloth. The work frame is positioned on a sewing machine bed 10A. The sewing machine 100B is provided with a horizontal driving mechanism 10B which moves the work frame 10 in accordance with X-Y coordinates indicated by the embroidery stitch data. By driving a needle rod and loop taker mechanism (not shown) while the work frame 10 is moved, an embroidering operation is executed to form a certain embroidery pattern on the work cloth.

The horizontal driving mechanism 10B, the needle rod, the loop taker mechanism and the like are controlled by a controller which includes a microprocessor and the like incorporated in the sewing machine 100B. Thus, the controller is capable of executing the embroidering operation automatically in accordance with the embroidery stitch data indicative of driving amount (i.e., the X-Y coordinates) of the work cloth at each stitch.

The embroidery sewing machine 100B is further provided with a flash memory device 11 in which the memory card 7 is removably inserted and the embroidery data can be retrieved therefrom.

Figure 1:
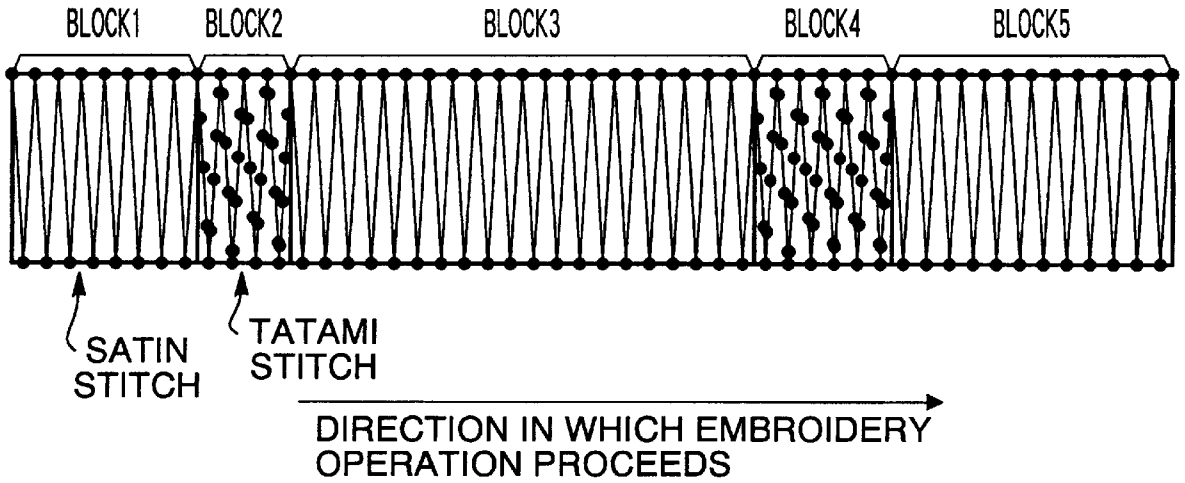
FIG. 1 is an example of embroidery stitch data including a plurality of embroidery blocks, which are aligned in a direction where an embroidering operation proceeds, having different stitch patterns.
Figure 2:
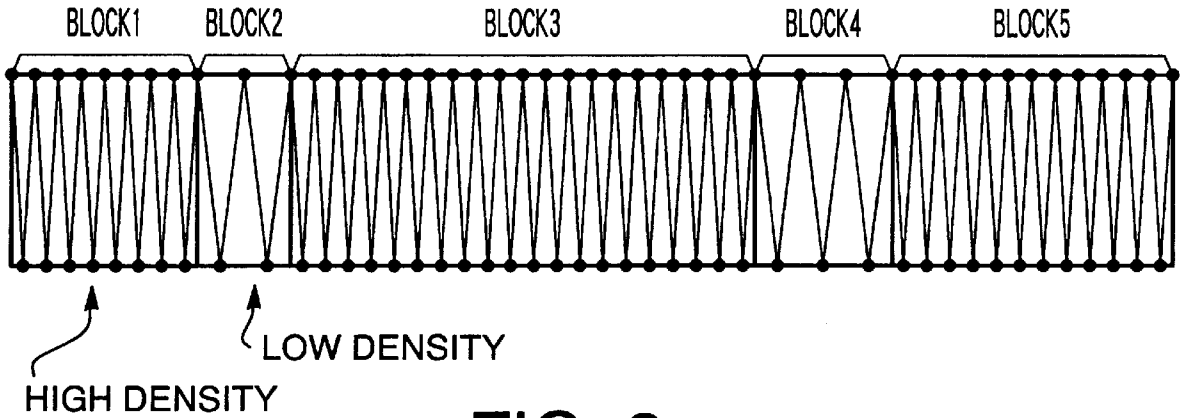
FIG. 2 is an example of embroidery stitch data including a plurality of embroidery blocks having different thread density.

FIG. 2 shows a control system of the embroidery data creating device 100A. The main body 1 of the embroidery data creating device 100A houses a control device CD. To an I/O (input/output) interface 22 of the control device CD, the CRT display 2, the keyboard 3, the mouse 4, the floppy disk drive 5, the flash memory device 6, and the hard disk drive 14 are connected.

The control device CD is provided with a CPU (Central Processing Unit) 20 which is connected with the I/O interface 22 through a bus 23. Further, a ROM (Read Only Memory) 21 and a RAM (Random Access Memory) 30 are connected to the CPU 20 through the bus 23.

The ROM 21 stores a control program for executing an embroidery data creating procedure. The RAM 30 includes an embroidery area data storage 31, a reference pattern data storage 32, and the like.

It should be noted that, according to the present embodiment, data on the embroidery area consisting of a plurality of embroidery blocks, through which embroidery is continuously formed, is to be stored in the embroidery area data storage 31 before the embroidery data creating procedure is carried out.

The embroidery data creating procedure executed by the control device CD will be described with reference to a flowchart shown in FIG. 5.

When the keyboard 3 is operated to start the embroidery data creating procedure, reference pattern data for one cycle, and a width M of the reference pattern in a direction in which the embroidering operation proceeds are determined and stored in the reference pattern data storage 32 (S10). Specifically, the number of threads within a length M in the direction where the embroidering operation proceeds, and intervals between the threads are determined. Further, a stitching point pattern indicative of points to be stitched for each thread is determined and stored in the reference pattern data storage 32.

Figure 6:
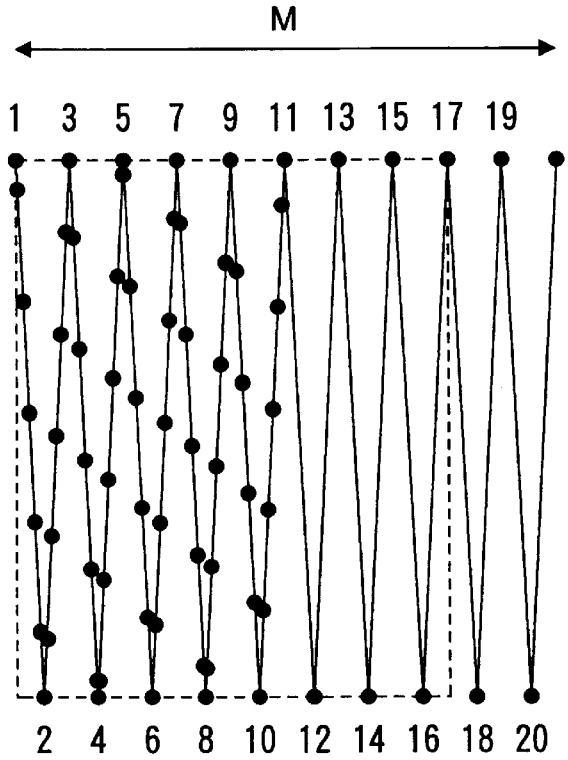
FIG. 6 is an example of stitch pattern data for one cycle.

For example, in FIG. 6, the number of thread segments (a segment connecting points 1 and 2, a segment connecting point 2 and 3, and the like) within the length M in the direction where the embroidering operation proceeds is 20. In this example, with respect to the first through tenth thread segments, a Tatami stitch is assigned; and with respect to the eleventh to twentieth thread segments, a satin stitch is assigned. The reference pattern data indicative of the stitch pattern shown in FIG. 6 is stored in the reference pattern data storage 32.

Figure 7:
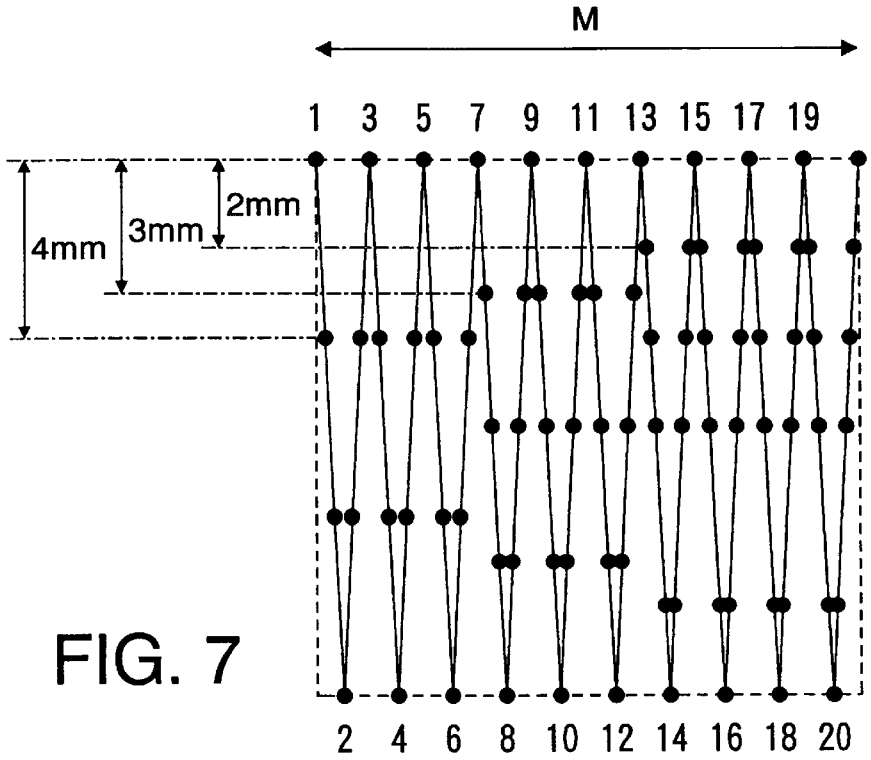
FIG. 7 is an example of stitch pattern data for one cycle.

FIG. 7 illustrates another example of the reference pattern data which can be stored in the reference pattern data storage 32. In this example, the number of thread segments is 20. To the first through sixth thread segments, a Tatami stitch having 4 mm pitch is assigned; to the seventh to twelfth thread segments, a Tatami stitch having 3 mm pitch is assigned; and to the thirteenth to twentieth thread segments, a Tatami stitch having 2 mm pitch is assigned.

Figure 8:
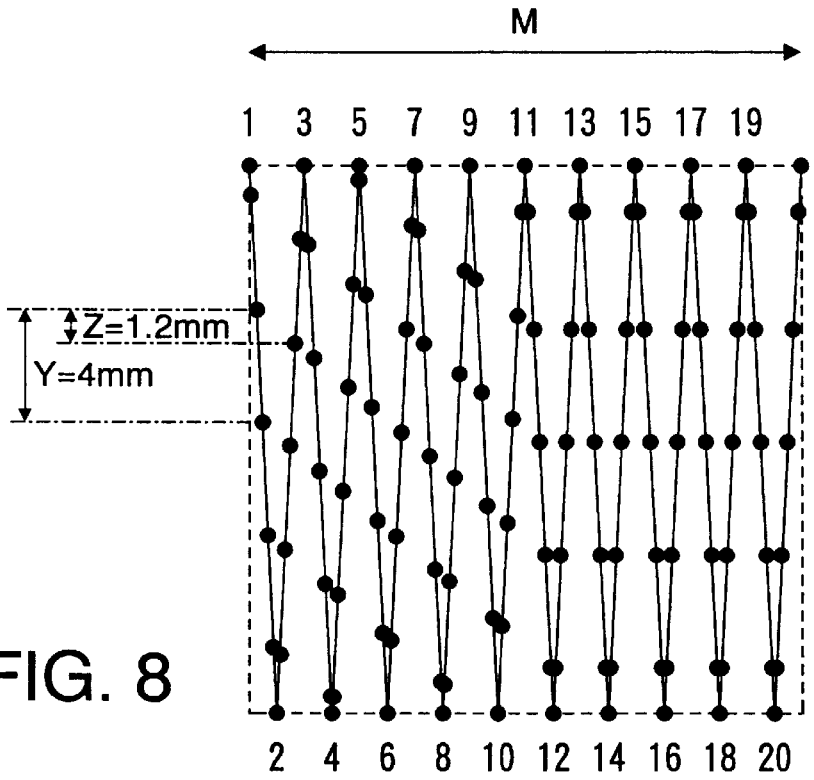
FIG. 8 is an example of stitch pattern data for one cycle.

FIG. 8 illustrates another example of the reference pattern data which can also be stored in the reference pattern data storage 32. In this example, the number of the thread segments is 20. To the first through tenth thread segments, a Tatami stitch having a shifting ratio of 30% is assigned, and to the eleventh to twentieth thread segments, a Tatami stitch having a shifting ratio is 0% is assigned. It should be noted that, the shifting ratio SR is defined by equation (1).

$$SR=Z/Y\times 100 \quad (1)$$

where, Z represents a shift amount of a stitching point between adjoining thread segments in a direction perpendicular to the direction where the embroidery operation proceeds, and Y represents a pitch between two successive stitching points for the same thread segment. As shown in FIG. 8, Z=1.2 mm, and Y=4 mm for the first to tenth thread segments; the shifting ratio therefor is 1.2/4.0×100=30%. For the eleventh to twentieth thread segments, Z=0 mm, and accordingly the shifting ratio is 0%.

Figure 9:
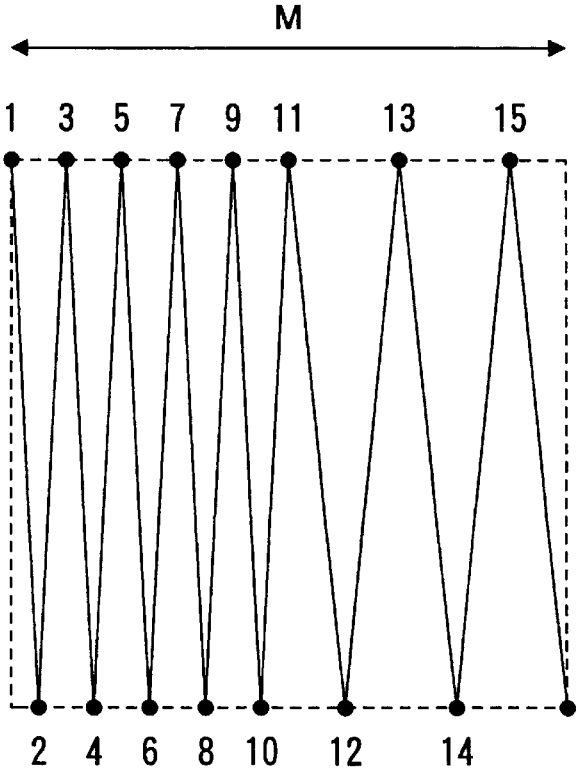
FIG. 9 is an example of stitch pattern data for one cycle.

FIG. 9 illustrates a further example of the reference pattern data which can also be stored in the reference pattern data storage 32. In this example, fifteen thread segments are arranged within the length M. An interval of adjacent thread segments for the eleventh through fifteenth thread segments is twice the interval for the other thread segments. In other words, density of the eleventh through the fifteenth thread segments is ½ of the density of the first to tenth thread segments.

In the embodiment, an embroidery area has been divided into a plurality of embroidery blocks. An embroidery block is retrieved from the embroidery area data storage 31 and then the embroidery block is divided into sub-blocks. In other words, sub-blocks are assigned to the embroidery block one by one, and each sub-block is developed into stitch pattern data with reference to the reference pattern data stored in the reference pattern data storage 32.

Firstly, a variable ml indicative of a start position of the reference pattern is set to zero (S11). Then, at S12, an embroidery block defined by four points P1P2P4P3 is retrieved from the embroidery area data storage 31.

Figure 10A:
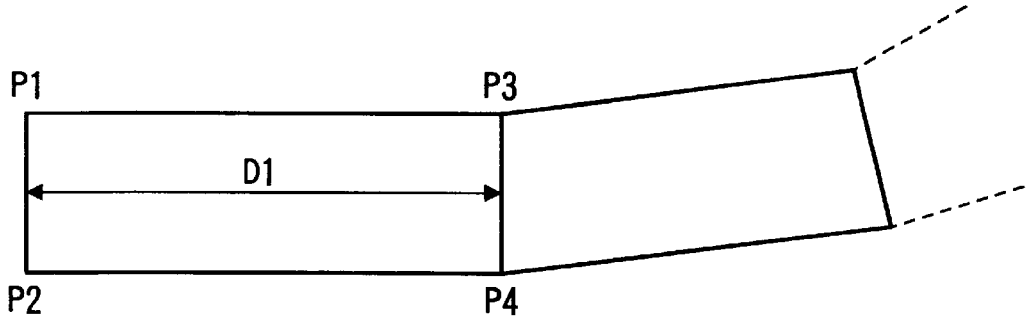
FIGS. 10A through 10D show a procedure in which an embroidery block is divided into sub-blocks.

Next, a length D between a central point of an auxiliary border P1P2 and a central point of an auxiliary border P3P4 is calculated. At the same time, a processed sub-block distance d indicative of a distance from a start position of the embroidery block to the end of a currently processed sub-block is set to (M−m1). Further, points Q1 and Q2 of a sub-block Q1Q2Q4Q3 is set to the points P1 and P2, respectively (S13). An initial width of the sub-block Q1Q2Q4Q3 is M, and if the sub-block Q1Q2Q4Q3 cannot be included in the currently processed embroidery block, the width of the sub-block is decreased. In the case of FIG. 10A, for example, D=D1, d=M, Q1=P1, and Q2=P2.

At S14, the sub-block distance d is compared with the length D of the embroidery block P1P2P4P3. If the processed sub-block distance d is equal to or less than the length D (S14:YES), points Q3 and Q4 satisfying the following equations (2) and (3) are determined as the points defining the end of the currently processed sub-block, and the end position m2 indicative of an end position of the reference pattern to be referred to is set to M. Thus, a sub-block Q1Q2Q4Q3 is determined (S15).

$$[P1Q3]/[P1P3]=d/D \quad (2)$$

$$[P2Q4]/[P2P4]=d/D \quad (3)$$

where, [ ] represents the length of the line segment, the point Q3 is located on a side P1P3, and the point Q4 is located on a side P2P3.

Figure 10B:
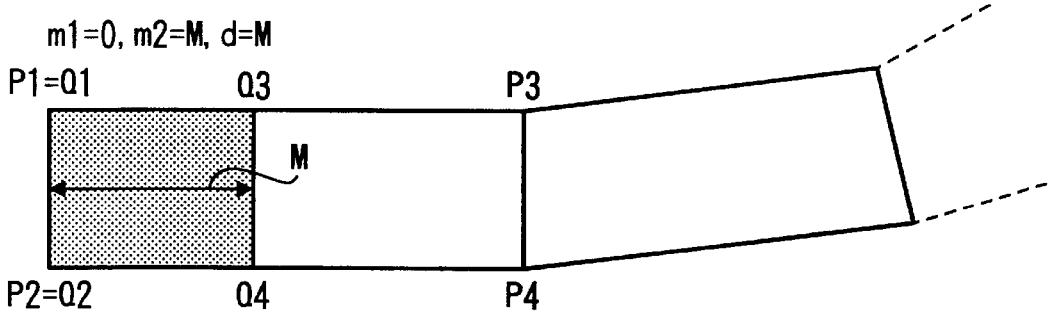

FIG. 10B shows an example of the sub-block Q1Q2Q4Q3. The sub-block Q1Q2Q4Q3 is developed into the embroidery stitch data in accordance with the reference pattern data stored in the reference pattern data storage 32 (S16). Specifically, the data to be referred to when the sub-block is developed into the embroidery stitch data is indicated by the start and end positions m1 and m2. In this example, since m1=0, and m2=M, the entire portion of the reference pattern data is referred to. In other words, the sub-block Q1Q2Q4Q3 is developed into the data identical to the reference pattern data, for example, shown in FIG. 6, which is stored in the reference pattern data storage 32.

After the first sub-block has been developed into the embroidery stitch data as described above, a subsequent sub-block is defined and developed into the stitch data in accordance with the similar procedure.

A new sub-block Q1Q2Q4Q3 is defined such that the points Q1 and Q3 of the new sub-block Q1Q2Q4Q3 are located at the points Q3 and Q4 of the previous sub-block. The start position ml is set to 0, the end position m2 is set to M, and the processed sub-block distance d is set to 2M (S17). Then, control returns to S14. Accordingly, until the processed sub-block distance d is determined to exceed the length D of the currently processed embroidery block at S14, the procedure of S14 through S17 is repeated.

Figure 10C:
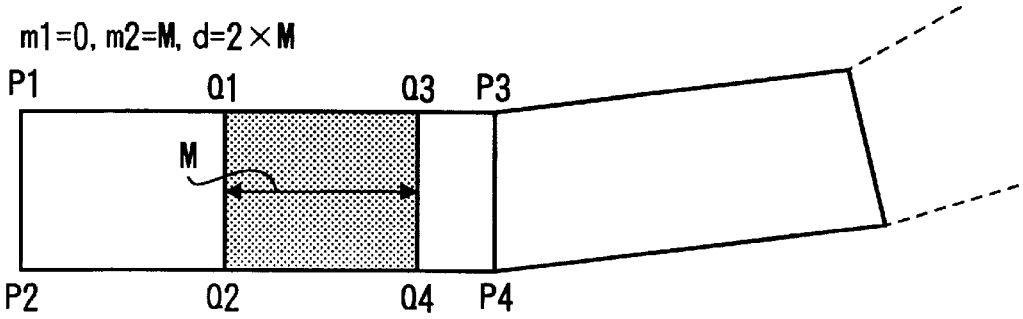

The first sub-block Q1Q2Q4Q3 is determined as shown in FIG. 10B, and developed into the embroidery stitch data as described above. Then, the second sub-block Q1Q2Q4Q3 is obtained as shown in FIG. 10C. Since the processed sub-block distance d is less than the length D, the second sub-block Q1Q2Q4Q3 also has a length M. and accordingly the developed stitch data is identical to the reference pattern data shown in FIG. 6 (S15 and S16).

Next, a third sub-block Q1Q2Q4Q3 is determined. Similarly to the case where the second sub-block is determined, the points Q1 and Q2 of the new (i.e., the third) sub-block are determined to be located at the points Q3 and Q4 of the previous (i.e., the second) sub-block (S17). Further, the processed sub-block distance d is increased by the length M (i.e., changed to d+M), and the start position m1 is set to zero. Then, control returns to S14.

Figure 10D:
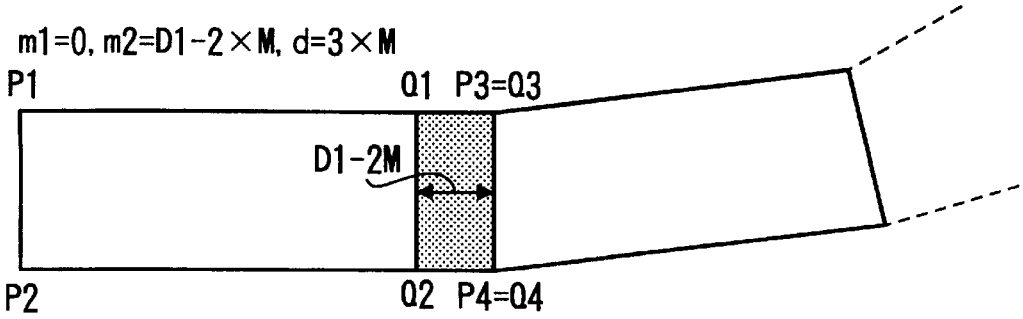

In this case, as shown in FIG. 10D, the newly calculated processed sub-block distance d (=3M) is greater than the actual length D (=D1) of the embroidery block P1P2P4P3 (S14:NO). In order to make the third sub-block Q1Q2Q4Q3 coincide with the remainder of the embroidery area P1P2P4P3, the points Q3 and Q4 of the third block are set to the positions P3 and P4, respectively (S18). Further, the end position m2 is set to (D−d+M) so that the area of the reference pattern data to be referred to corresponds to the sub-block Q1Q2Q4Q3 shown in FIG. 10D.

Figure 11:
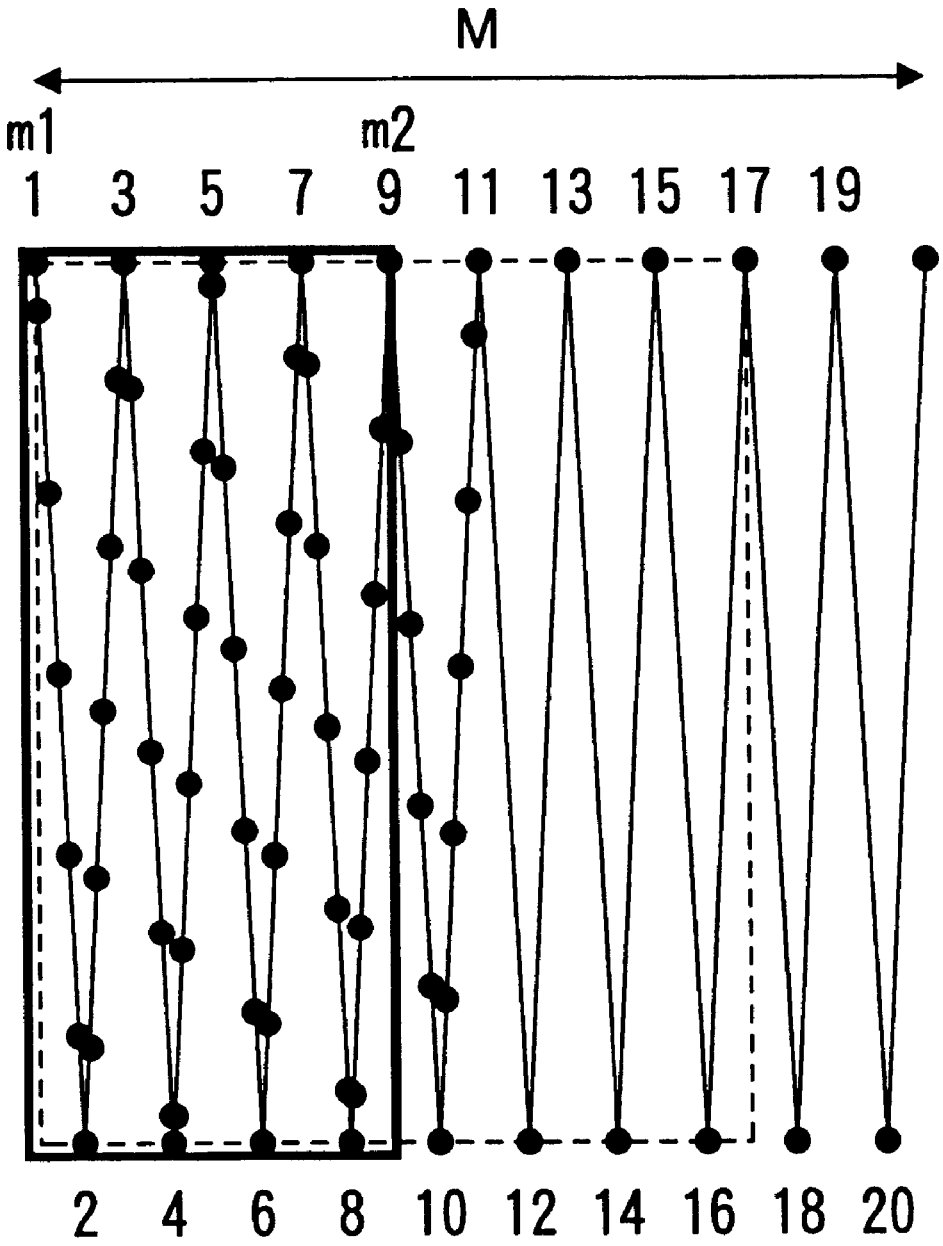
FIG. 11 shows the embroidery stitch data corresponding to a sub-block shown in FIG. 10D.

In this case, when the sub-block Q1Q2Q4Q3 is developed into the stitch data, a portion, defined by the start and end positions m1 and m2, of the pattern data stored in the reference pattern data storage 32 is used (S19). FIG. 11 shows the cyclical pattern data, and a rectangular portion between the start and end positions m1 and m2 is used for developing the sub-block Q1Q2Q4Q3 shown in FIG. 10D.

At S20, the start position m1 is set to a value of the end position m2 to prepare for processing of a subsequent embroidery block. Accordingly, the start position m1 now represents the start position of the remainder of the reference pattern data shown in FIG. 11.

At S21, it is determined whether an embroidery block, having a stitch pattern which is continuously connected to the stitch pattern of the embroidery block P1P2P4P3, is to be connected to the currently processed embroidery block P1P2P4P3.

If another embroidery block is to be connected (S21:YES), the subsequent embroidery block is retrieved from the embroidery area data storage 31 (S22), and then control returns to S13.

Figure 12A:
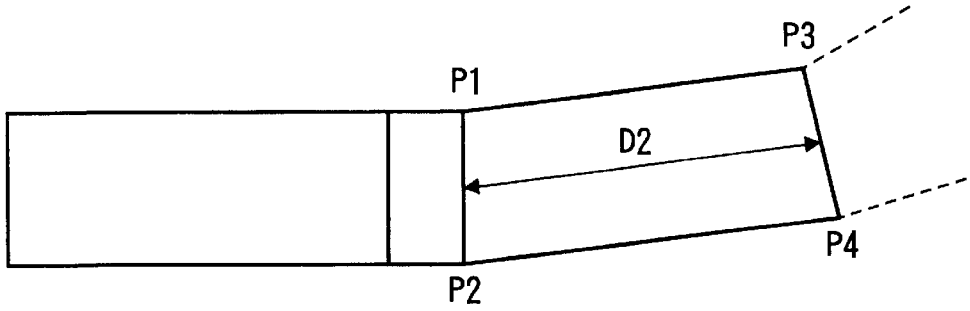
FIGS. 12A and 12B show a procedure in which another embroidery block is divided into sub-blocks.
Figure 12B:
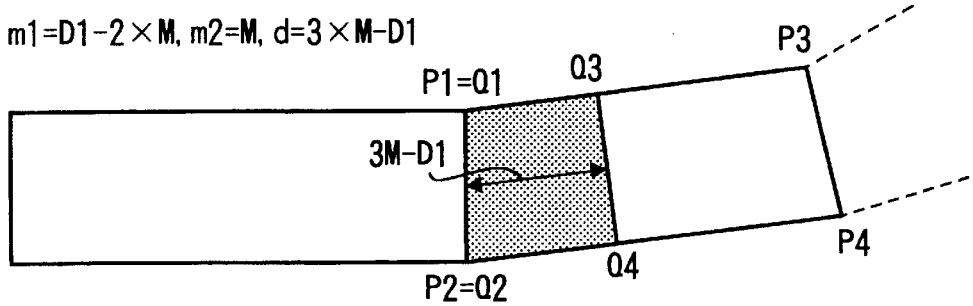

FIGS. 12A and 12B show an example of the embroidery block P1P2P4P3 connected to the embroidery block described above. At S13, the length D is determined to have a length D2, and processed sub-block distance d is set to (M−m1). It should be noted that, for the new embroidery block, the processed sub-block distance d represents a distance from the border P1P2 of the new (i.e., currently processed) embroidery block P1P2P4P3 to the end of a sub-block.

As described above, the start point m1 of the reference pattern data has been set to (D1−2M). Therefore, the processed sub-block distance d is calculated by equation (4).

$$d=M-(D1-2M)=3M-D1 \quad (4)$$

At S14, the processed sub-block distance d is determined to be less than D2 (S14:YES), and the sub-block Q1Q2Q4Q3 as shown in FIG. 12B is determined. As described above, the start position m1 and the end position m2 of the reference pattern to be referred to for developing the sub-block Q1Q2Q4Q3 shown in FIG. 12B are (D1−2M) and M, respectively.

Figure 13:
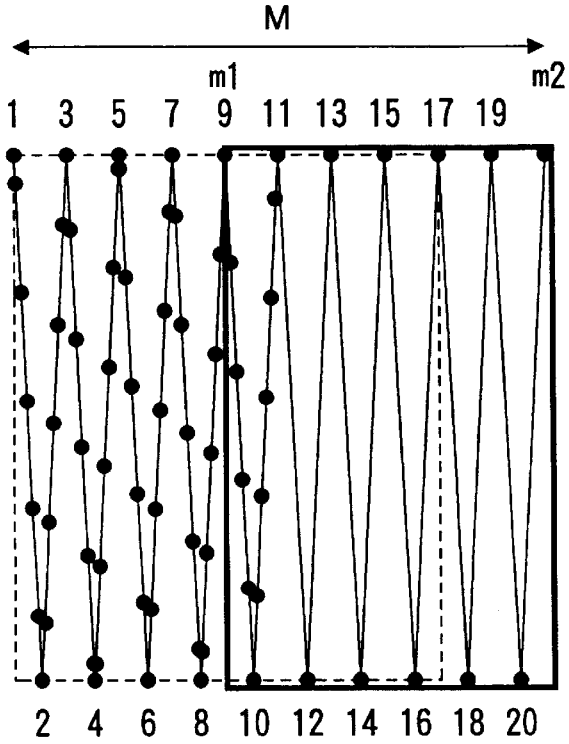
FIG. 13 shows the embroidery stitch data corresponding to a sub-block shown in FIG. 12B.

FIG. 13 illustrates the reference pattern data, and a rectangular portion between the start and end positions m1 and m2 are used for developing the sub-block Q1Q2Q4Q3 shown in FIG. 12.

Figure 5:
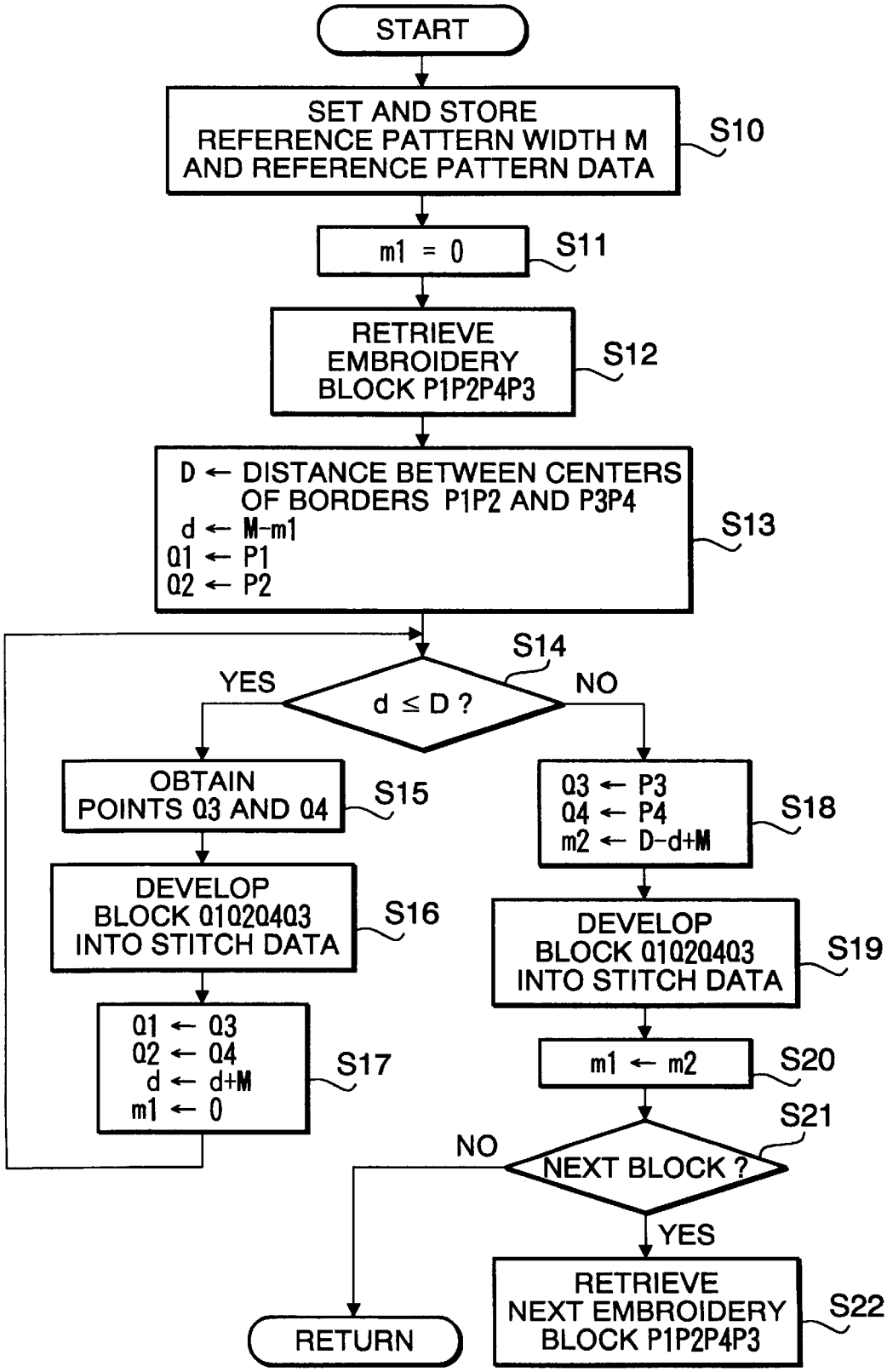
FIG. 5 is a flowchart illustrating a procedure for creating the embroidery data.

If it is determined, at S21, that there is no block to be connected (S21:NO), the procedure shown in FIG. 5 is terminated.

According to the above-described procedure, an embroidery area data consisting of embroidery blocks among which stitches are continuously formed, is developed into the embroidery stitch data representative of an embroidery consisting of cyclically changing stitch patterns.

Figure 14:
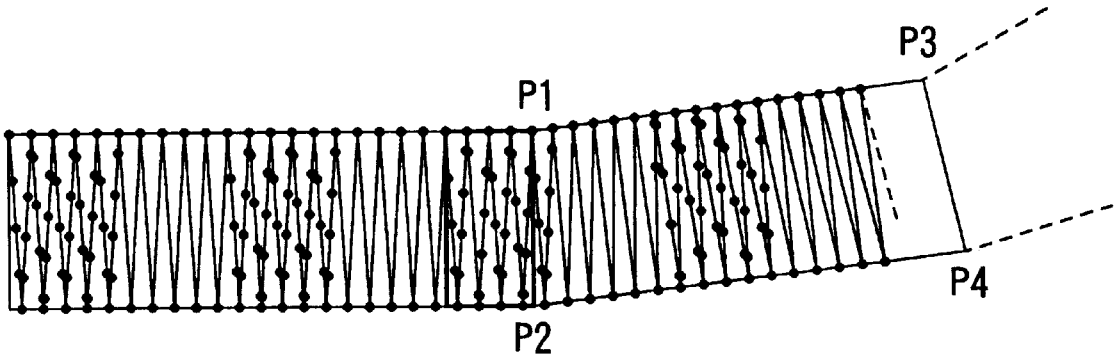
FIG. 14 is an example of embroidery stitch data created by the embroidery data creating device.

FIG. 14 shows an embroidery which is formed based on the embroidery stitch data obtained by the above-described procedure.

In the above-described embodiment, the embroidery stitch data represents repetitive stitch patterns, and the data is created in accordance with each embroidery block having the straight main borders.

Figure 15A:
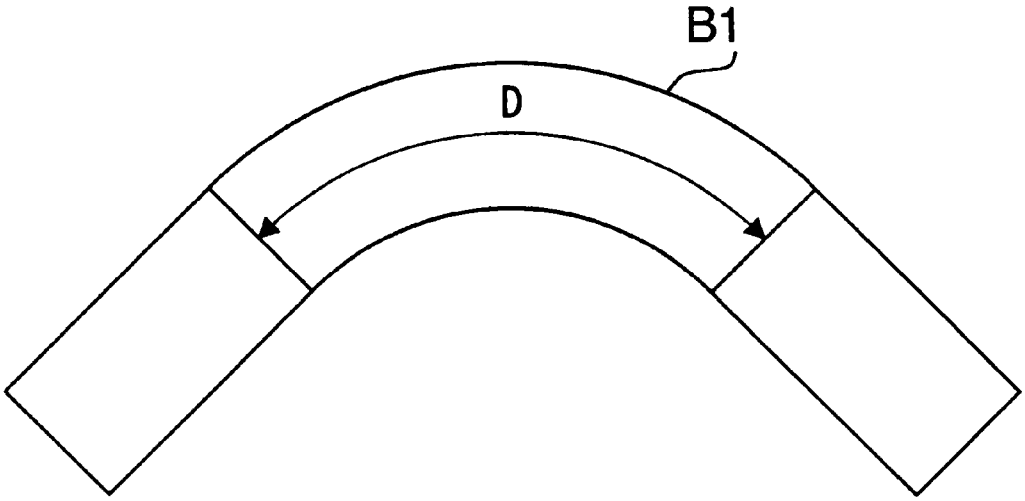
FIGS. 15A and 15B show an example of embroidery area including an arc-shaped embroidery block.
Figure 15B:
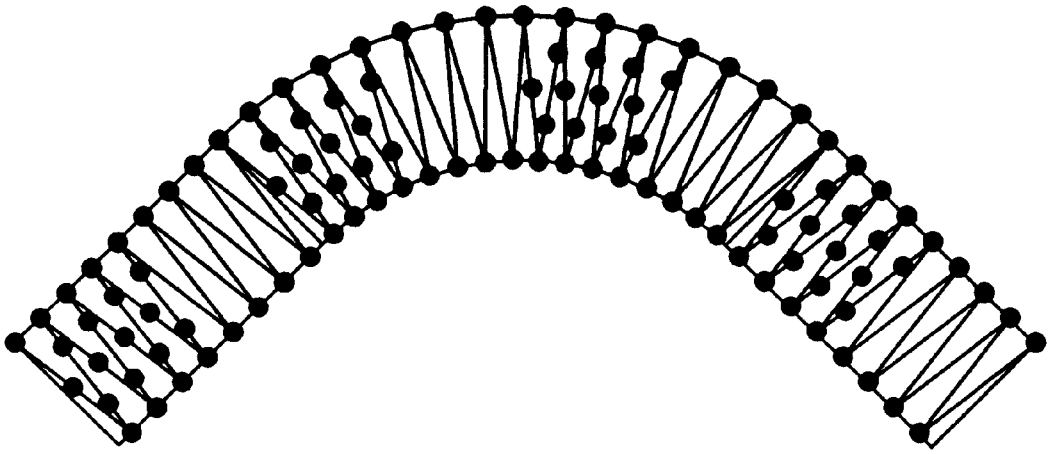

FIG. 15A shows another example of the embroidery area. In this example, the main borders of at least one of the embroidery block B1 have curved portions. FIG. 15B shows the stitched pattern corresponding to the embroidery area shown in FIG. 15A.

Figure 16A:
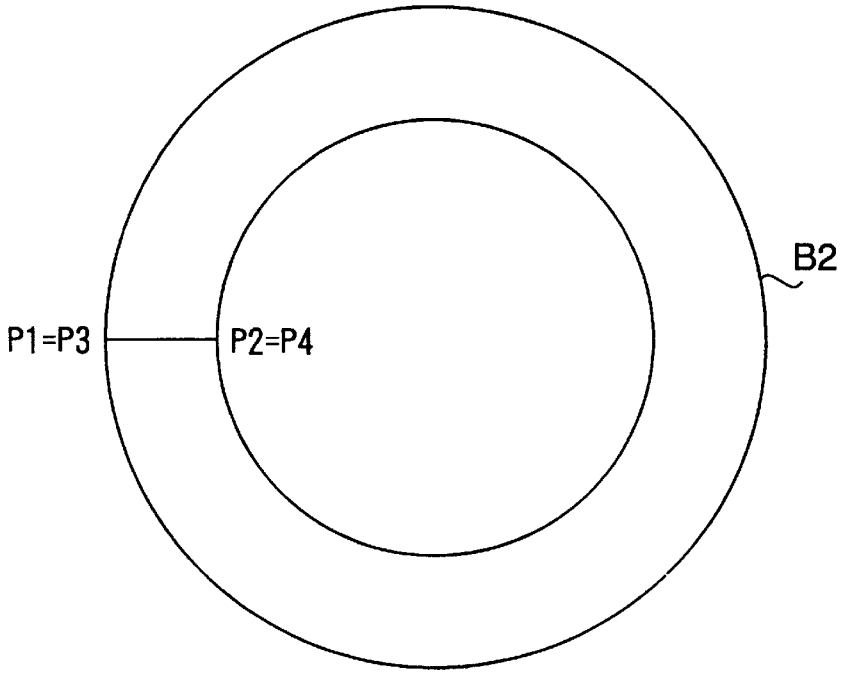
FIGS. 16A and 16B show an example of the embroidery area having an annular shape.
Figure 16B:
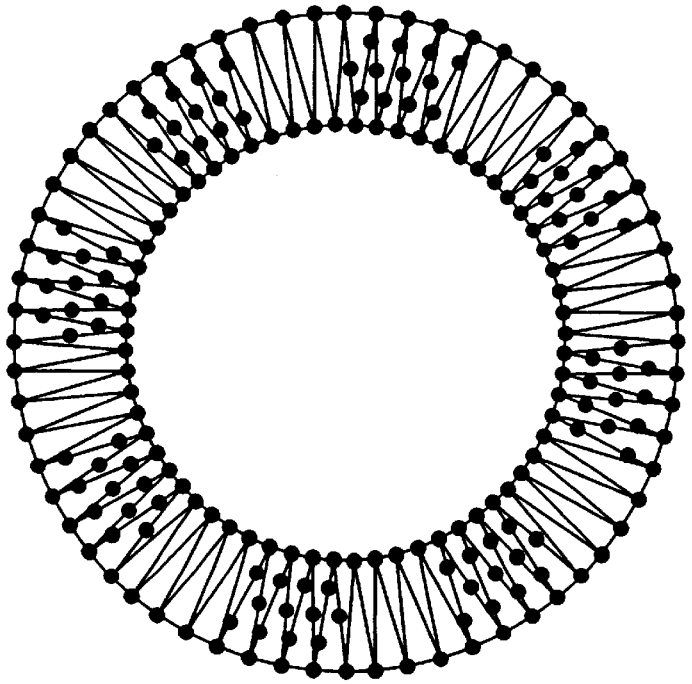

FIG. 16A shows further example of the embroidery area. In this example, as shown in FIG. 16A, the embroidery area consists of an annular-shaped embroidery block B2 which is defined by two concentric circles. As indicated on the drawing, the start position P1 coincides with the end position P3, and the start position P2 coincides with the end position P4 (i.e., the two auxiliary borders of the embroidery block B2 coincide). As shown in FIG. 16B, the embroidery which is formed in accordance with the embroidery stitch data corresponding to the embroidery area shown in FIG. 16A has cyclically repeated patterns.

In the above examples, the pattern shown in FIG. 6 is used as a reference pattern. It should be noted that any pattern can be used as the reference pattern. For example, the pattern shown in FIG. 7, FIG. 8, or FIG. 9 can also be used as the reference pattern.

It should also be noted that the embroidery data creating device described above is not necessarily limited to a device based on the personal computer system, but various modifications can be made. For example, the embroidery data creating device may be constructed as a device built in a sewing machine, or a device composed of a particular hardware only for creating the embroidery data.

The present disclosure relates to the subject matter contained in Japanese Patent Application No. HEI 09-67692, filed on Mar. 21, 1997, which is expressly incorporated herein by reference in its entirety.

What is claimed is:

1. An embroidery data creating device for creating embroidery stitch data representative of cyclically repeated embroidery patterns to be formed on an embroidery area, comprising:

a first memory, which stores data related to said embroidery area, said embroidery area including at least one embroidery block;

a second memory, which stores reference pattern data indicative of a varied unit pattern of said cyclically repeated embroidery patterns; and a data generating device, which generates said embroidery stitch data for said embroidery area stored in said first memory in accordance with said reference pattern data stored in said second memory.

2. The embroidery data creating device according to claim 1, wherein said data generating device generates said embroidery stitch data by arranging said reference pattern data repeatedly within said embroidery area.

3. The embroidery data creating device according to claim 1, wherein said at least one embroidery block comprises a block defined by a first pair of line segments extending in a direction where an embroidery operation is to proceed, and a second pair of line segments connecting the ends of said first pair of line segments, and wherein said first pair of line segments are straight line segments.

4. The embroidery data creating device according to claim 1, wherein said at least one embroidery block comprises a block defined by a first pair of line segments extending in a direction where an embroidery operation is to proceed, and a second pair of line segments connecting the ends of said first pair of line segments, and wherein said first pair of line segments have curved portions.

5. The embroidery data creating device according to claim 1, wherein said embroidery area is an annular shaped area.

6. The embroidery data creating device according to claim 1, wherein said reference pattern data represents a pattern including a plurality of different stitching methods.

7. The embroidery data creating device according to claim 6, wherein said plurality of different stitching methods include a Tatami stitch.

8. The embroidery data creating device according to claim 6, wherein said plurality of different stitching methods include a satin stitch.

9. The embroidery data creating device according to claim 1, wherein said reference pattern data represents a pattern within which a density of thread segments is varied.

10. The embroidery data creating device according to claim 1, wherein said reference pattern data represents a pattern including a plurality of kinds of Tatami stitches.

11. The embroidery data creating device according to claim 10, wherein said plurality of kinds of Tatami stitches include Tatami stitches having different stitching pitches.

12. The embroidery data creating device according to claim 10, wherein said plurality of kinds of Tatami stitches include Tatami stitches having different stitch point shifting ratios.

13. The embroidery data creating device according to claim 1, wherein said at least one embroidery block comprises a first embroidery block and a second embroidery block, said data generating device arranges a plurality of said reference patterns one by one in said first and second embroidery blocks, and wherein if only a portion of said reference pattern is used as a lastly arranged reference pattern in said first embroidery block, the remainder of said reference pattern is used as a firstly arranged reference pattern in said second embroidery block.

14. The embroidery data creating device according to claim 1, further comprising a removable memory device, said embroidery stitch data generated by said data generating device being stored in said removable memory device.

15. The embroidery data creating device according to claim 14, wherein said removable memory device can be coupled to an embroidery sewing machine, wherein said embroidery stitch data stored in said removable memory device can be supplied to said embroidery sewing machine when said removable memory device is coupled to said embroidery sewing machine.

16. An embroidery data creating device for creating embroidery stitch data for an embroidery area consisting of at least one embroidery block, comprising:

means for dividing each of said at least one embroidery block into at least one sub-block having a predetermined width in a direction where said at least one embroidery block is divided; and means for developing each of said at least one sub-block into embroidery stitch data with reference to reference pattern data indicative of an embroidery pattern including a plurality of portions having different characteristics.

17. A computer accessible memory medium for an embroidery data creating device for creating embroidery stitch data representative of cyclically repeated embroidery patterns to be formed on an embroidery area, said memory medium containing a program to be executed by said embroidery data creating device, said program including steps of:

storing data related to said embroidery area, said embroidery area including at least one embroidery block;

storing reference pattern data indicative of a varied unit pattern of said cyclically repeated embroidery patterns; and generating said embroidery stitch data for said embroidery area in accordance with said reference pattern data.

18. The memory medium according to claim 17, wherein said embroidery stitch data is generated by arranging said reference pattern data repeatedly within said embroidery area.

19. The memory medium according to claim 17, wherein said at least one embroidery block comprises a block defined by a first pair of line segments extending in a direction where an embroidery operation is to proceed, and a second pair of line segments connecting the ends of said first pair of line segments, and wherein said first pair of line segments are straight line segments.

20. The memory medium according to claim 17, wherein said at least one embroidery block comprises a block defined by a first pair of line segments extending in a direction where an embroidery operation is to proceed, and a second pair of line segments connecting the ends of said first pair of line segments, and wherein said first pair of line segments have curved portions.

* * * * *